US008641459B1

(12) United States Patent
Matsuoka et al.

(10) Patent No.: US 8,641,459 B1
(45) Date of Patent: Feb. 4, 2014

(54) POWER BRICK WITH ACTUATOR MECHANISM

(75) Inventors: Yoshimichi Matsuoka, Cupertino, CA (US); Jeffrey Hayashida, San Francisco, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/475,304

(22) Filed: May 18, 2012

(51) Int. Cl.
*H01R 11/01* (2006.01)

(52) U.S. Cl.
USPC ..... 439/777

(58) Field of Classification Search
USPC ..... 439/777.172, 131, 166, 573, 518, 655, 439/794, 801; 219/521
See application file for complete search history.

(56) References Cited

U.S. PATENT DOCUMENTS

| | | | | | |
|---|---|---|---|---|---|
| 4,973,827 | A | * | 11/1990 | Nozaki | 219/521 |
| 4,997,381 | A | * | 3/1991 | Oh | 439/172 |
| D338,188 | S | | 8/1993 | Lee et al. | |
| 5,613,863 | A | * | 3/1997 | Klaus et al. | 439/131 |
| 5,684,689 | A | * | 11/1997 | Hahn | 363/146 |
| 6,086,395 | A | | 7/2000 | Lloyd et al. | |
| D428,862 | S | * | 8/2000 | Queffelec et al. | D13/184 |
| D456,008 | S | | 4/2002 | Kawanobe et al. | |
| D478,310 | S | | 8/2003 | Andre et al. | |
| D478,546 | S | | 8/2003 | Andre et al. | |
| D479,823 | S | | 9/2003 | Andre et al. | |
| D498,462 | S | | 11/2004 | Andre et al. | |
| D519,922 | S | | 5/2006 | Andre et al. | |
| D552,034 | S | | 10/2007 | Hobson et al. | |
| D573,946 | S | | 7/2008 | Ledbetter et al. | |
| D587,192 | S | | 2/2009 | McGinley et al. | |
| D593,031 | S | | 5/2009 | Miyatake et al. | |
| D595,654 | S | | 7/2009 | Andre et al. | |
| D599,738 | S | | 9/2009 | Amidei et al. | |
| 7,621,765 | B1 | * | 11/2009 | Wu | 439/173 |
| D611,415 | S | | 3/2010 | Andre et al. | |
| D621,782 | S | | 8/2010 | Chang et al. | |
| 7,766,698 | B1 | * | 8/2010 | De Iuliis et al. | 439/638 |
| D623,136 | S | | 9/2010 | Andre et al. | |
| D638,357 | S | | 5/2011 | Sasada et al. | |
| D639,238 | S | | 6/2011 | Serrano | |
| 8,087,946 | B2 | * | 1/2012 | Namiki et al. | 439/173 |
| D658,123 | S | | 4/2012 | Andre et al. | |
| D662,473 | S | | 6/2012 | Andre et al. | |
| 8,222,773 | B2 | | 7/2012 | De Iuliis et al. | |
| 8,382,526 | B2 | * | 2/2013 | Chen et al. | 439/655 |
| 2002/0127898 | A1 | * | 9/2002 | Liu | 439/131 |
| 2002/0168891 | A1 | | 11/2002 | Kitou et al. | |
| 2004/0204177 | A1 | * | 10/2004 | Pon | 455/573 |
| 2009/0117765 | A1 | * | 5/2009 | Wen et al. | 439/166 |
| 2011/0053410 | A1 | * | 3/2011 | Namiki et al. | 439/518 |

* cited by examiner

*Primary Examiner* — Alexander Gilman
(74) *Attorney, Agent, or Firm* — Lerner, David, Littenberg, Krumholz & Mentlik, LLP

(57) ABSTRACT

An example power adaptor is provided. In one aspect, the power adaptor may include a brick and a cable. The brick may further an actuator mechanism configured to allow detachment and attachment of a removable outlet attachment.

16 Claims, 7 Drawing Sheets

POWER BRICK WITH ACTUATOR MECHANISM

BACKGROUND

In certain power adaptors, it may be desirable to configure the adaptor to allow removal of an outlet attachment. However, such removable outlet attachments may prove to be confusing or difficult to remove. For example, the direction of force to apply may not be clear to a user. In this regard, the application of force may be required in a direction that is counterintuitive with respect to the overall orientation of the adaptor. Additionally, the amount of force required to remove the outlet attachment may be prohibitive for those with limited manual dexterity.

BRIEF SUMMARY

According to one aspect of the disclosure, a power adaptor is provided. The power adaptor may include a housing including a plurality of faces. The power adaptor may also include an outlet attachment removably coupled to the housing, and the outlet attachment may include a recess formed in a surface of the housing and at least one channel. The power adaptor may also include an actuator mechanism. The actuator mechanism may include a button, disposed on one of the plurality of faces of the housing. The button may be configured to move between a plurality of positions. The actuator mechanism may also include a projection configured to be disposed within the recess when the button is in a first position and to be removed from the recess when the button is in a second position. The actuator mechanism may also include a slide configured to exert a first force on a surface of the at least one channel when the button is moved from the first position to the second position. In one example, the power adaptor may include a biasing member configured to bias the button toward the first position. In another example, the projection may have an angled face. In another example, the power adaptor may further include a button support attached to the button, the projection, and the slide. The button, the button support, the projection, and the slide may be integrally formed. The power adaptor may include a cable attached to one of the plurality of faces, and the cable may be configured to supply power to a device. In one example, a given one of the plurality of faces of the housing may include a notch formed therein, and the notch may include an opening extending along a dimension of the given face. In one example, the housing may have a substantially rectangular cuboid shape. In one example, the first force may be exerted by the slide in a direction perpendicular to the face on which the button is disposed. In one example, the slide may have a raised portion for exerting the first force on the surface of the at least one channel. The at least one channel may have a raised end that correspondingly couples to the raised portion of the slide. In one example, the slide of the actuator mechanism may include a pair of slides and each of the pair of slides includes the raised portion, and the at least one channel of the outlet attachment may includes a pair of channels and each of the pair of channels may include a raised end that couples to the raised portion for a corresponding one of the pair of slides. In one example, the projection may be configured to be removed from within the recess when the button is in an intermediate position between the first and second positions. In one example, the first force may be exerted by the slide through movement between the first and intermediate positions and between the intermediate and second positions. In one example, the slide may effect the first force to act through a distance sufficient to cause ejection of the outlet attachment from the housing. In one example, the outlet attachment may further include an extension cable configured to provide power to the housing.

DETAILED DESCRIPTION

According to aspects of the disclosure, a power adaptor includes an outlet attachment that may be detached or attached to a "brick" or other type of housing. According to one implementation, the brick may be a transformer module configured to convert power provided by a wall outlet to the desired type (e.g., AC or DC), polarity, voltage, etc. The brick may also include an actuator mechanism that enables the detachment or attachment of the outlet attachment. For example, the actuator mechanism may include a button that may move between a first, second, and third position. In the first position, or the rest position, a projection of the actuator mechanism is disposed within a recess, preventing removal of the outlet attachment. In this position, a slide of the actuator mechanism is aligned with a channel of the outlet attachment. Upon moving the button to a second position, or a released position, the projection is moved out of the recess. In the released position, the outlet attachment may be removed by a user. The button may be further moved to a third position, or an ejected state. In this regard, the slide may travel within the channel, and a raised portion of the slide may exert a force in an interior surface of the channel in a direction perpendicular to a face on which the button is disposed. This force may cause the outlet attachment to be ejected, where it may be further removed by a user.

Figure 1:
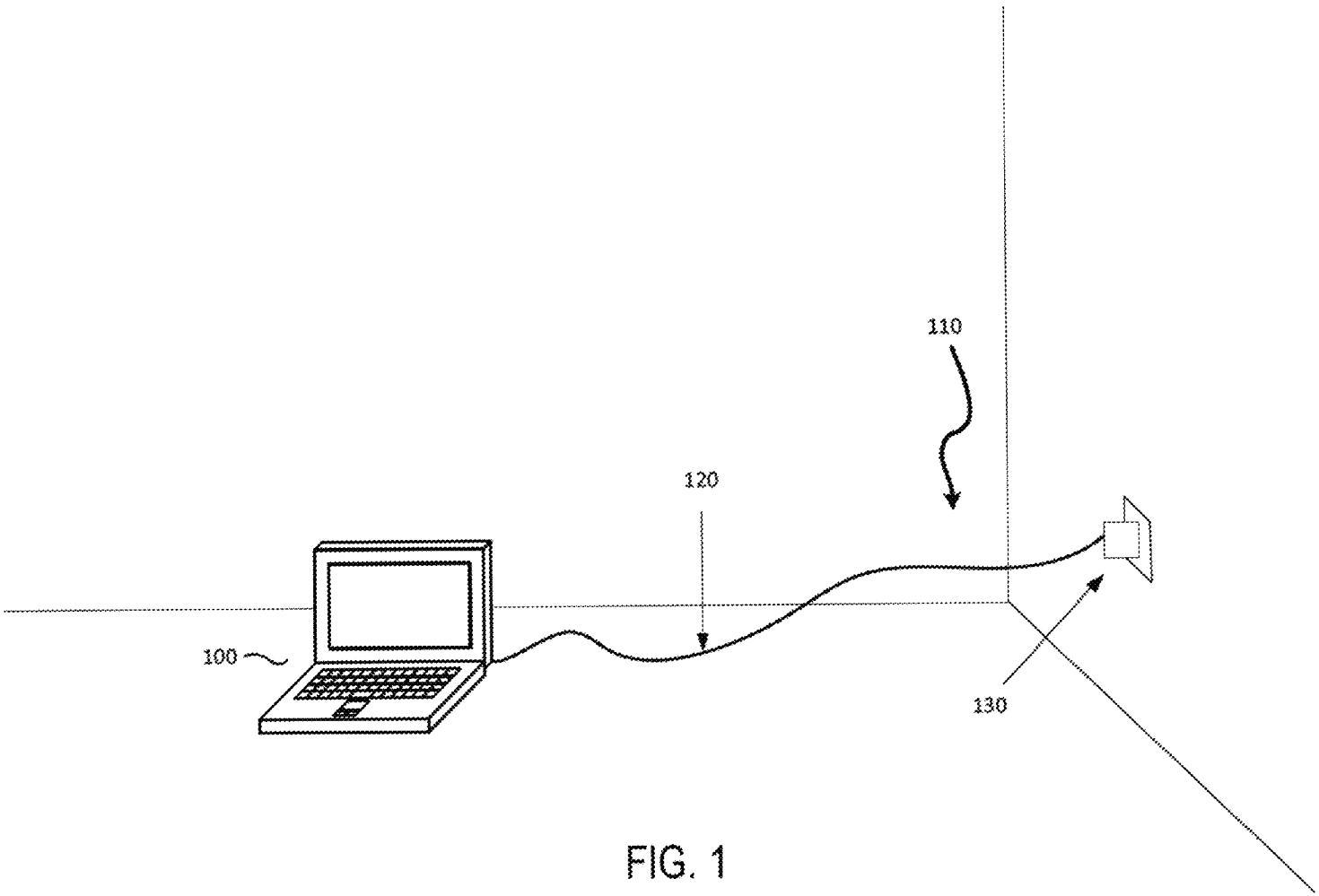
FIG. 1 is an overview of a computer with an example power adaptor connected thereto, according to aspects of the disclosure.

FIG. 1 is an overview of a computer 100 with an example power adaptor 110 connected thereto, according to aspects of the disclosure. In this example, the power adaptor 110 is connected to a computer 100 and is also connected to an electrical outlet on a wall. In this way, power from the electrical outlet may be supplied to the computer 100.

The power adaptor 110 may be connected to an electrical outlet, and power may be provided to the computer 100. Power provided to the computer 100 may charge an internal battery (not shown) of the computer 100, or may alternatively directly power the computer 100, including any components attached thereon or thereto, such as an external hard drive, printer, USB drive, speakers, headphones, or any other component capable of being connected to any of the computing devices mentioned above.

The computer 100 may be any type of computer, such as a laptop computer, personal computer, a mobile computing device, a personal digital assistant (PDA), a mobile phone, a tablet or other handheld computing device. Moreover, the computer 100 may be any other type of computing device, including, but not limited to, a storage medium (e.g., a hard drive), a networking component (e.g., a switch, router, a modem, a server, a host, etc.), or a gaming device (e.g., a console gaming device or a handheld gaming device). The above list is not exhaustive, and many other computing devices not listed may be used with the example power adaptor 110.

The computer 100 may also include a processor (not shown), a memory/storage (not shown), and other components typically present in a computer. For instance, memory/storage may store information accessible by processor, including instructions that may be executed by the processor and data that may be retrieved, manipulated or stored by the processor. The memory/storage may be of any type or any device capable of storing information accessible by the processor, such as a hard-drive, ROM, RAM, CD-ROM, flash memories, write-capable or read-only memories. The processor may comprise any number of well-known processors, such as a CPU. Alternatively, the processor may be a dedicated controller for executing operations, such as an ASIC.

The power adaptor 110 may include a cable 120 and a brick 130. The cable 120 may connect at one end to the computer 100 and may connect at another end to the brick 130. The cable 120 may be of any size or dimension suitable for transmitting AC or DC power from brick 130 to computer 100. For example, the cable 120 may have any length desired to allow connection to a power supply, and in one example may have a length of up to 30 feet. A cross section of cable 120 may be of any shape, such as circular, oval, rectangular, or any other two-dimensional geometric shape. In one example, cable 120 may have a substantially circular cross section with a diameter of up to 1 cm. In another example, cable 120 may have a diameter of approximately 4.0 mm+/−1.0 mm.

Cable 120 may be any type of cable capable of transmitting either AC or DC power to a computer 100. For example, cable 120 may include one or more conductor layers of a conductive material, such as copper wire, with an insulation/non-conducting layer or sheath formed therearound or between multiple layers. In addition to transmitting power, the cable 120 may also transmit data. In one example, the cable 120 may include a separate fiber optic cable for transmitting a fiber optic signal. In yet another example, the cable 120 may transmit both power and data over a single transmission medium or multiple conductive layers.

As discussed above, the cable 120 may include a first end that may be connected to the brick 130 via an interface 138. In this way, the first end of the cable 120 may be detachably secured to a corresponding interface on the brick 130. In another example, the cable 120 may be rigidly or at least semi-permanently assembled with the brick 130. The cable 120 may also include a second end that connects to the computer 100, which will be discussed in greater detail below.

The brick 130 may be connected to an electrical outlet at one end and may provide an AC or DC power supply to cable 120 to be delivered to computer 100. Brick 130 may include an exterior housing and may include power management circuitry therein that can be configured, for example, to convert power provided by a wall outlet to the desired type (e.g., AC or DC), polarity, voltage, etc. The housing may be formed of any material suitable for containing electrical circuitry, and in one example may be formed of a polymer, such as a plastic or polycarbonate/acrylonitrite butadiene styrene (PC/ABS).

Figure 2:
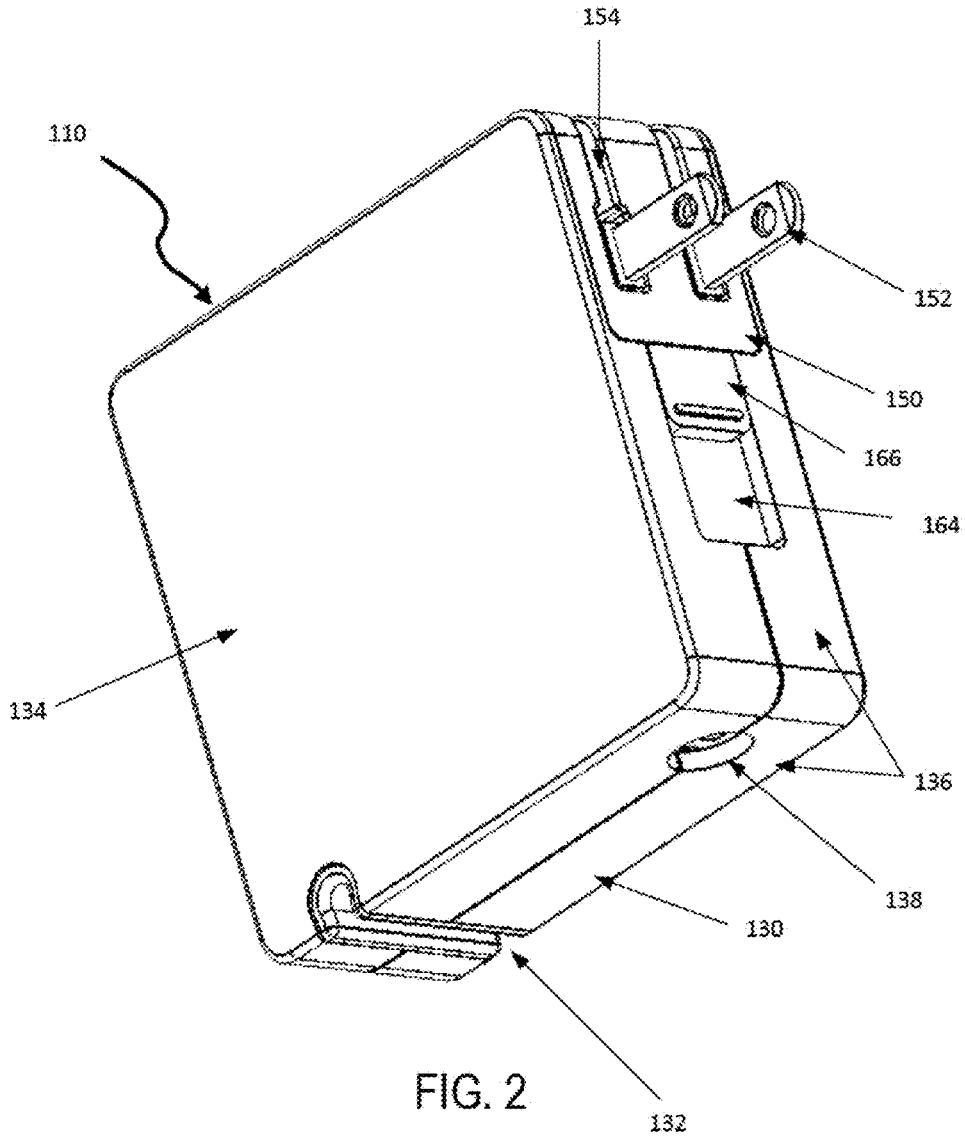
FIG. 2 is a perspective view of an example power adaptor according to aspects of the disclosure.

Brick 130 may be formed in any geometric shape, and in one example, as shown in FIG. 2, may be a substantially rectangular cuboid, e.g., a three-dimensional substantially rectangular box. Brick 130 may have a height, length, and a depth of any size or dimension, such as, for example, 6 cm×6 cm×3 cm or 4 cm×4 cm×2 cm. In some implementations, brick 130 may include six faces, with each face having an opposing face. Each of the faces may have a length and a width that matches a length and a width of the opposing face. In one example, brick 130 may include two major faces 134 and four minor faces 136. The two major faces may be opposed to one another, and may each have a total area larger than each of the remaining four minor faces. Each of the four minor faces may each be opposed to another minor face. In one example, the two major faces may be substantially square and the four minor faces may be substantially rectangular. In one example, the corners formed between faces may form angles, such as right angles. In another example, the corners of the brick 130 may be rounded.

As mentioned above, the brick 130 may include internal power management circuitry. In one example, the brick 130 may include a rectifier for converting an electrical signal from an outlet and delivering the signal to the cable 120. The electrical outlet may be a wall outlet and may provide an 120V alternating current (AC) signal. In this way, the rectifier may convert an AC signal from an outlet to a direct current (DC) voltage to be delivered to the computer 100. In one example, the brick 130 may provide a DC voltage in the range of approximately 10 to 25V. In another example, brick 130 may not include a rectifier, and may provide an AC signal to the computing device. In any of the above examples, brick 130 may include additional circuitry to alter or modify either an AC or DC power signal, such as but not limited to a voltage divider, capacitor, or diodes.

Figure 7:
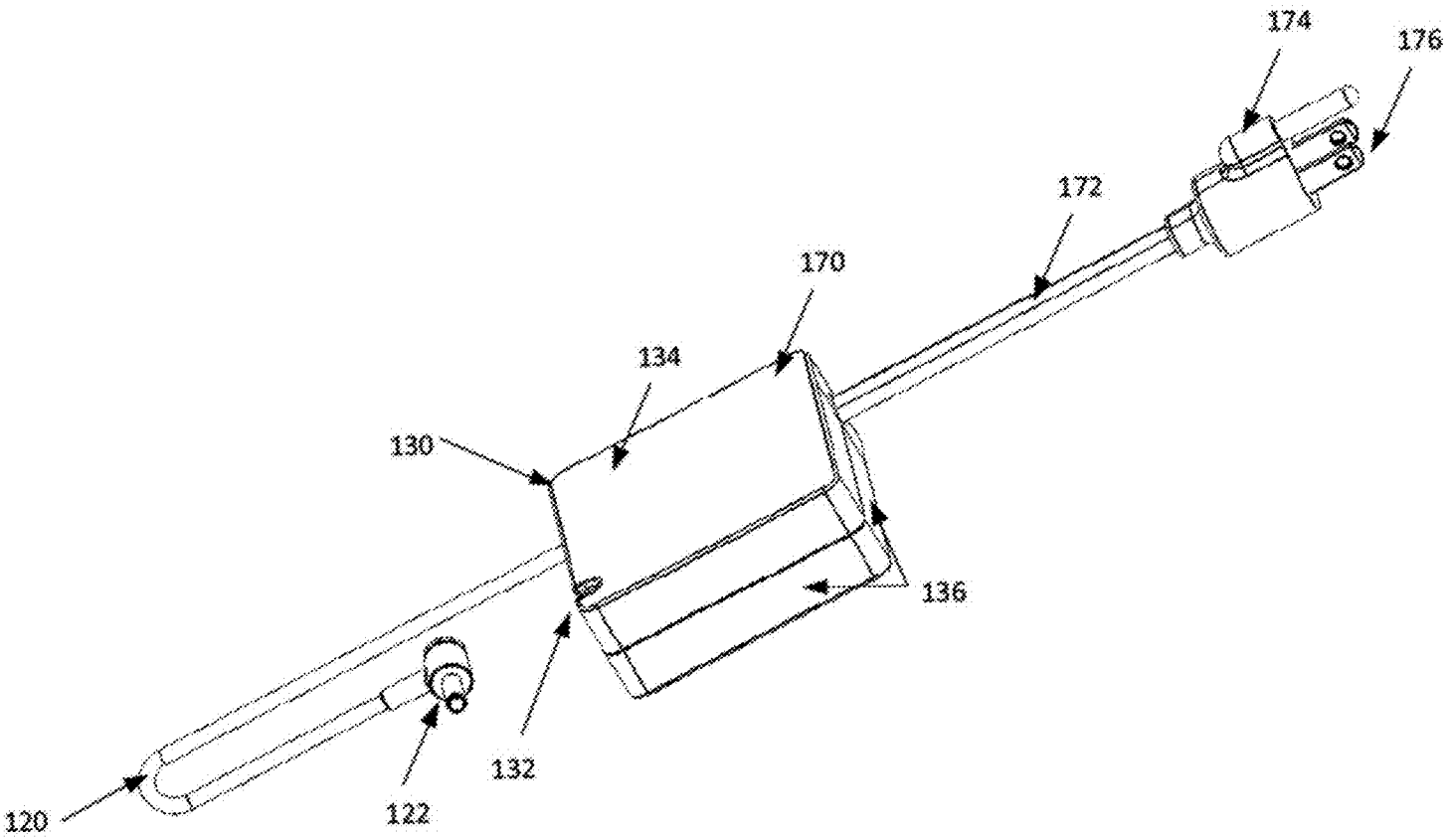
FIG. 7 is a perspective view of a power adaptor according to another aspect of the disclosure.

FIG. 2 is a perspective view of the example power adaptor 110. As discussed above, the power adaptor 110 may include the cable 120 and the brick 130. The cable 120 may terminate in a connector 122, as shown in FIG. 7, which may be connected to a corresponding power jack on computer 100. The connector may be any type of connector capable of delivering AC or DC power and/or data to a computing device. In another example, connector may be compatible with USB, HDMI, VGA, PS2, or any other type of port on a computer.

The brick 130 may also include an outlet attachment 150. The outlet attachment 150 may include one or more prongs 152 for connecting to an electrical outlet. The outlet attachment 150 may further include a plurality of channels 154, allowing the prongs 152 to be rotated and stored within the channels 154. The outlet attachment 150 may include an outlet attachment interface 156, which may connect to a corresponding interface 157 on the brick 130, allowing the prongs 152 to be electrically connected with the brick 130. The outlet attachment 150 may be releasably secured to the brick 130 by a button 166 of an actuator mechanism 160, which will be described in greater detail below. This allows for different types of attachments to be used in conjunction with brick 130. For example, an attachment with a two- or three-prong North American-style plug may be used. In another example, attachments that conform to the outlets of various other countries may be used. In yet another example, the outlet attachment may be compatible with a cigarette lighter adaptor. In yet another example, the outlet attachment 150 may be configured for an extension cable, as shown in FIG. 6.

The brick 130 may also include a notch 132. The notch 132 may be formed on a minor face of the brick 130, and may extend along a width of the minor face, extending between adjacent major faces. The notch 132 may be a cutout portion in the housing of brick 130 and may be sized and shaped to receive an insert (not shown). A length of the cable 120 may be wrapped around the brick 130, and a portion of the cable 120 may be inserted and secured within the insert.

Figure 3:
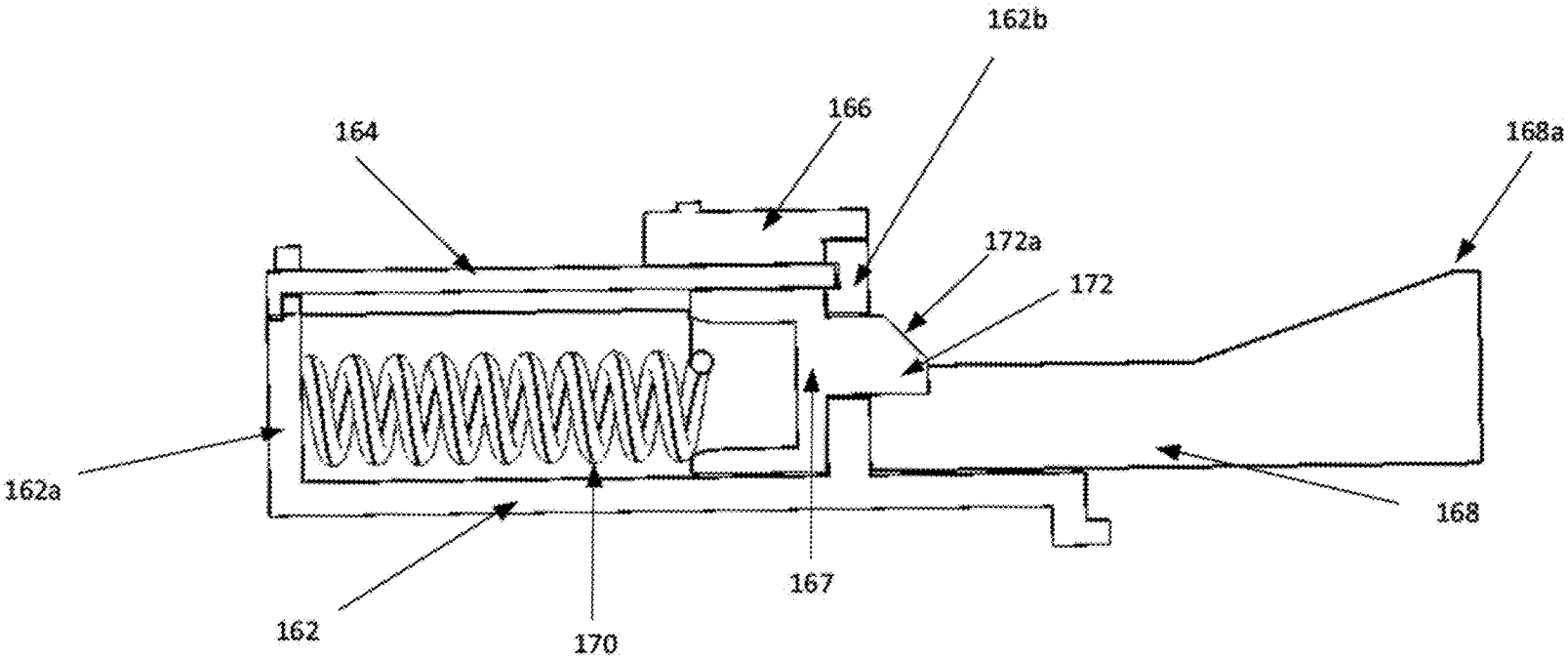
FIG. 3 is an isolated view of an actuator mechanism that can be incorporated in the adaptor of FIG. 2.

FIG. 3 is an isolated view of an actuator mechanism 160 that can be incorporated in the adaptor of FIG. 2. The actuator mechanism 160 may include a base 162, a guide 164, a button 166, a slide 168, and a biasing member 170. As will be described in greater detail below, the button 166 may be moved from between first, second, and third positions along the guide 164. Each of the positions causes the actuator mechanism 160 to enter a first, second, and third state, respectively. The biasing member 170 provides a force that may bias the button 166 in the first position, and an application of manual force to the button 166 may overcome the bias force and allow the button 166 to be moved to the second position or third position. Movement of the button 166 to the second position may cause the actuator mechanism to enter a second state. In the second state, the projection 172 moves out from within a recess 159 formed in a surface of the outlet attachment 150, allowing removal of the outlet attachment 150 from the brick 130 by a user. In the second state, the slide 168 may be moved within a channel 158 of the outlet attachment 150, but may not exert a force on the outlet attachment sufficient to cause ejection of the outlet attachment. The button may further be moved to a third position, causing the actuator mechanism to enter a third state. In the third state, the slide 168 moves within the channel 158, and a raised portion 168*a* of the slide exerts a force on the channel 158, causing a force sufficient to eject the outlet attachment 150 from the brick 130.

The base 162 may be generally U-shaped, and in one example may have a flat bottom, and may have a first end 162*a* and a second end 162*b*. The first end 162*a* may be attached to the guide 164, and in one example the guide 164 may be embedded within the first end 162*a*. The first end 162*a* may also be connected to the biasing member 170. The second end 162*b* may also be attached to the guide 164, and in one example the guide 164 may be embedded within the second end 162*b*. The base 162 may be formed of any material, such as a polymer. The base 162 may be removably attached to the brick 130, or may be integrally formed therewith.

The actuator mechanism 160 may also include a guide 164. The guide 164 may be attached to the base 162 and may guide the button 166 between the first, second, and third positions. The guide 164 may be formed of any material, such as a polymer.

The button 166 may oriented along one side of the guide 164 and may move between a first position, a second position, and a third position. The first, second, and third positions may cause the actuator mechanism to enter a first, second, and third state, respectively. Movement of the button 166 between the first, second, and third positions may occur upon the application of force by a user in a direction parallel to the plane of the face on which the button 166 is disposed. In the first position, or the rest position, the projection 172 of the actuator mechanism 160 prevents the attachment 150 from being detached from the brick 130, which will be described in greater detail below. Upon application of force, the button 166 may be moved toward a second position, or a released position. In the released position, the projection 172 may be moved from within the recess 159 of the outlet attachment 150, and the outlet attachment 150 may be removed by a user. The button may further be moved to a third position, or an ejected position. Movement of the button 166 toward the third position may cause a force to be exerted on the outlet attachment 150 in a direction perpendicular to the plane of the face upon which the button 166 is disposed. This perpendicular force may cause the outlet attachment 150 to separate from the brick 130 by virtue of movement of the button 166 toward the released position and the resulting perpendicular force, and may not require a user to manipulate the outlet attachment 150 itself to cause detachment. In another example, the outlet attachment 150 may partially disengage with the brick such that it remains attached to brick 130 but can be more easily removed from the brick 130 by a user.

The button 166 may be connected to a button support 167. The button support 167 may be integrally formed with the button 166 and may connect the button to the slide 168 and the biasing member 170 and the projection 172, as will be described below. The button support 167 may abut the end 162*b* of the base 162 in the rest position. In this way, the force from the biasing member 170 on the button support 167 may be ultimately exerted on the end 162*b*, thereby preventing the button 166 from advancing past the rest position when the button 166 is moving from the released position to the rest position.

While button 166 is depicted as a button that moves in a direction parallel to the face on which it is disposed, the button 162 may be any type of control or switch mechanism, such as a push button, or any other touch-sensitive device. For example, a user may apply a force to a push button in a direction perpendicular to the face on which the push button is disposed, or in any other direction with respect to the faces of the brick 130.

The actuator mechanism 160 may also include a slide 168. The slide 168 may be connected directly or indirectly to the button 166 such that movement of the button between the first, second, and third positions causes the slide 168 to move between corresponding first, second, and third positions. In one example, the slide 168 and the button 166 are integrally formed. The slide 168 may engage with a channel 158 formed in, or on, the outlet attachment 150. In one implementation, the actuator mechanism 160 may include more than one slide 164 and the outlet attachment 150 may include more than one channel 158.

As described above, the movement of the button 166 from the first position to the second position causes the slide 168 to move from a first position to the second position. In the first position, the slide 168 aligns with and fits within the channel 158 of the outlet attachment 150. In this regard, the slide 168 has a raised portion 168*a* and the channel 158 includes a raised end 158*a*. The raised end 158*a* and raised portion 168*a* may have a similar shape such that the raised portion 168*a* may fit within the raised end 158*a*. As the slide 168 moves toward the released position, the raised portion 168*a* of the slide 168 moves within the channel 158 from the raised end 158*a* to another end 158*b* that is opposed to the raised end 158*a*. According to one implantation, the end 158*b* may have an opening height that is less than the raised end 158*a*. As the raised portion 168*a* advances within the channel 158 toward the end 158*b*, the height of the channel may decrease. In this regard, the movement of the raised portion 168*a* may exert a force on an interior surface of the channel 158, thereby exerting a force on the outlet attachment 150. The force exerted may be in a direction perpendicular to the face on which the button 166 is disposed. In the second position, the force may not be sufficient to eject the outlet attachment 150 from the brick 130. As the button 166 is moved to the third position, the slide 168 moves to a corresponding third position. As the slide 168 moves toward the third position, the raised portion 168*a* moves toward the other end 158*b* of the channel 158. As the height of the channel decreases, the force exerted by the raised portion 168*a* of the slide 168 increases. When the slide 168 reaches the third position, the raised portion 168*a* of the slide 168 exerts a force on the channel 158 sufficient to cause ejection of the outlet attachment 150 from the brick 130.

The actuator mechanism 160 may also include a biasing member 170. In one example, the biasing member may be a spring. The biasing member 170 may be connected at one end to the base 162. At the other end, the biasing member may engage with any one of the button 166, slide 168, or projection 172 and bias the same toward the rest position. In this way, the button 166, slide 168 and projection 172 will not move toward the released position without an application force sufficient to cause the button to overcome the biasing member 170.

Figure 4:
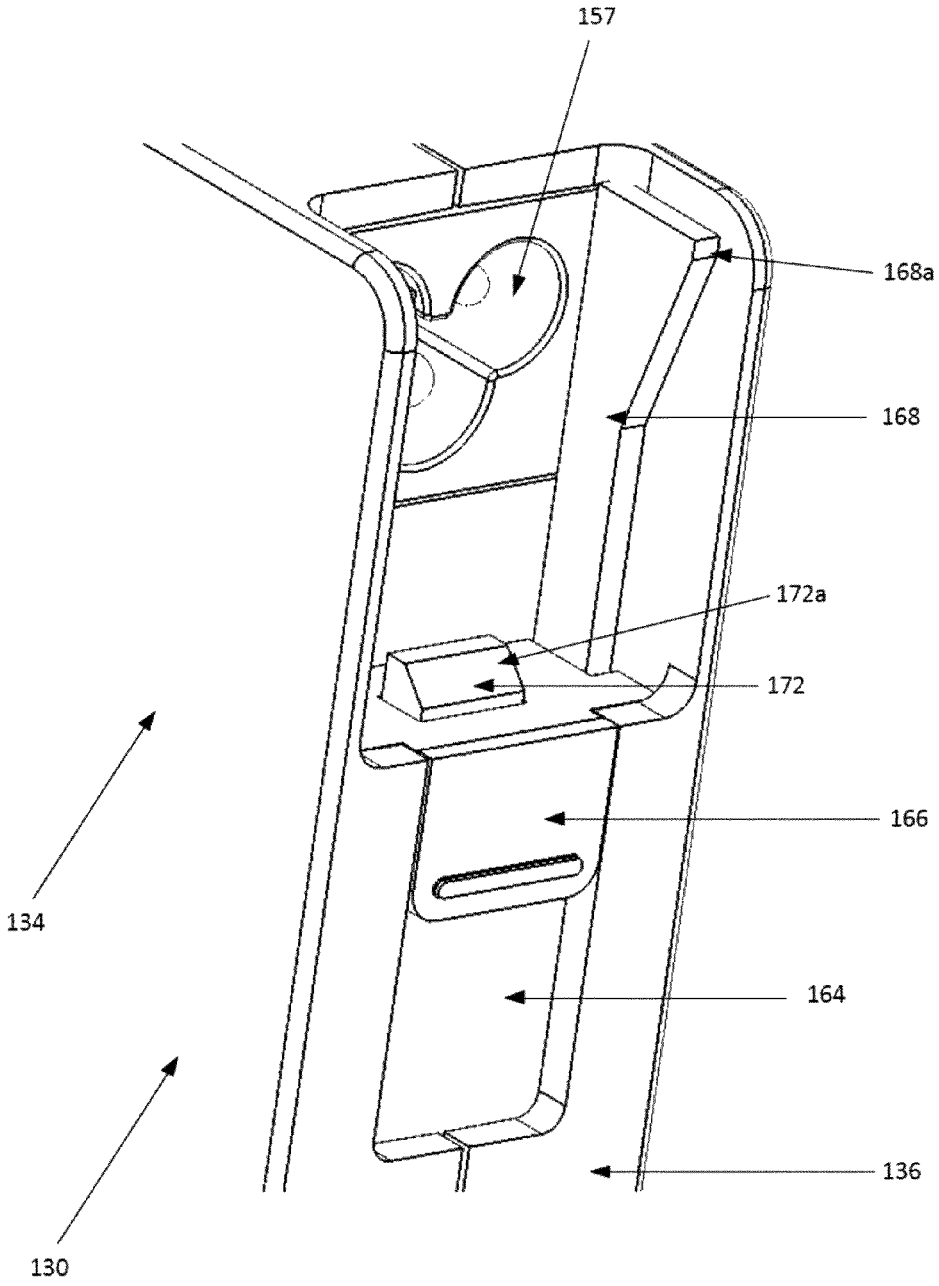
FIG. 4 is a perspective view of the adaptor of FIG. 2 with the outlet attachment detached therefrom.

The actuator mechanism 160 may also include a projection 172, as shown in FIGS. 4 and 5A. The projection 172 may be connected directly or indirectly to the button 162 and movement of the button from the first position to the second position may cause the projection 172 to move from a corresponding first position to a corresponding second position. In the first position, the projection 166 fits within a recess 159 of the outlet attachment. In this regard, the projection prevents the outlet attachment 150 from being removed from, or from disengaging with, the brick 130. If a user attempts to remove the outlet attachment 150 while the button 166 is in the first position, an interior surface of the recess 159 will encounter the projection 172, thereby preventing movement. When the button 166 is moved to the second position, the projection 172 is also moved to a second position. In the second position, the projection is moved from within the recess 159, and the outlet attachment 150 may then be removed, as movement of the recess 159 is no longer obstructed by the projection 172. A user may remove the outlet attachment 150 either by applying a manual removing force to the outlet attachment 150, or alternatively, by continuing to move the button 166 toward the third position.

Figure 5:
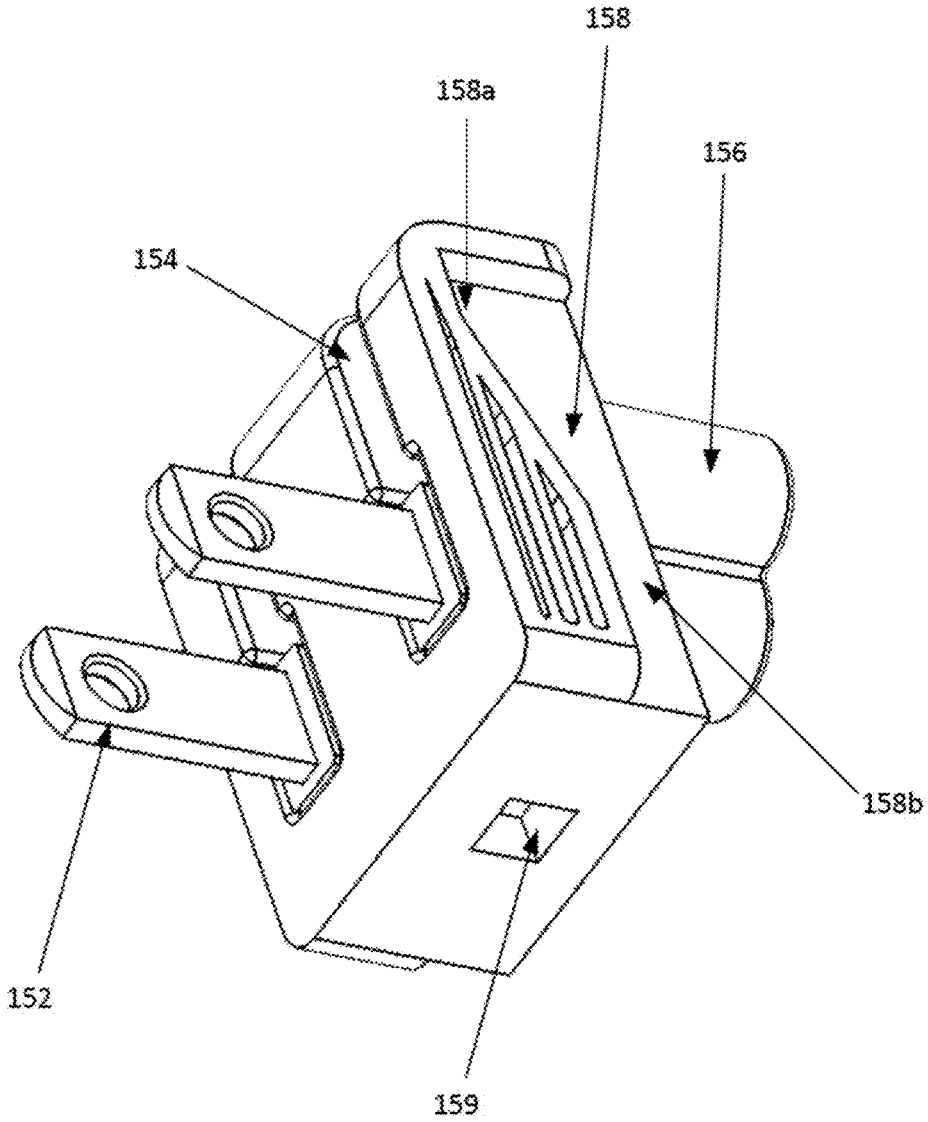
FIG. 5 is a perspective view of the outlet attachment 150 of FIG. 2.

FIG. 4 is a perspective view of the adaptor 110 of FIG. 2 with the outlet attachment 150 detached therefrom and FIG. 5 is a perspective view of the outlet attachment 150 of FIG. 2. In this example, the button 166 is shown in the rest position. As shown in FIG. 5, the outlet attachment 150 may include a channel 158 and a recess 159. The channel 158 may be sized and shaped to receive the slide 168. The recess 159 may be sized and shaped to receive the projection 172. The projection 172 may include an angled face 172*a*. The angled face 172*a* may allow a user to replace the detached outlet attachment 150 without the need for manipulation of the button 166. For example, when a user is reattaching the outlet attachment 150, an outer portion of the outlet attachment 150 may come into contact with the angled face 172*a* of the projection 172. Upon application of force by the user in a direction perpendicular to the face on which the button is disposed, a force may be applied to the angled face 172*a* of the projection 172. A component of the force may be directed in a direction parallel to the face on which the button is disposed, causing the button support 167 to apply a force to the biasing member 170. The biasing member may be compressed upon this application of force, allowing the projection to be moved toward the second position. In the second position, the force on the projection 172 may be relieved by virtue of the recess 159. In this regard, the projection 172 may return to the rest position, where it is then disposed within the recess. The outlet attachment 150 is then secured to the brick 130.

Figure 6A:
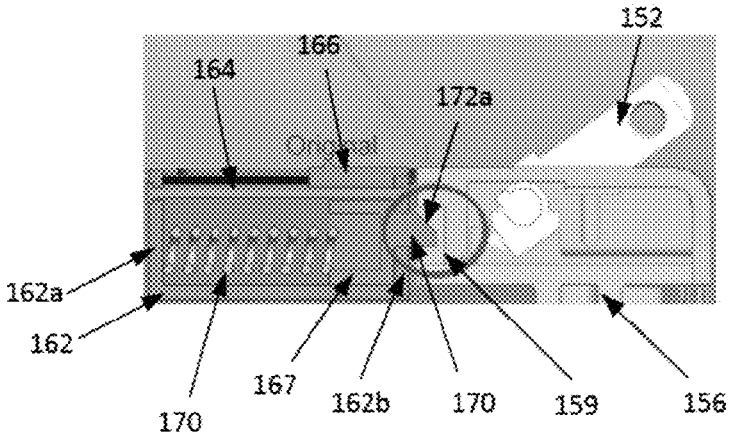
FIG. 6A is a cross-sectional view of the actuator mechanism of FIG. 3.

FIG. 6A is a cross-sectional view of the actuator mechanism of FIG. 3. In this example, the actuator mechanism is configured in a rest position. As described above, the projection 172 is shown within the recess 159.

Figure 6B:
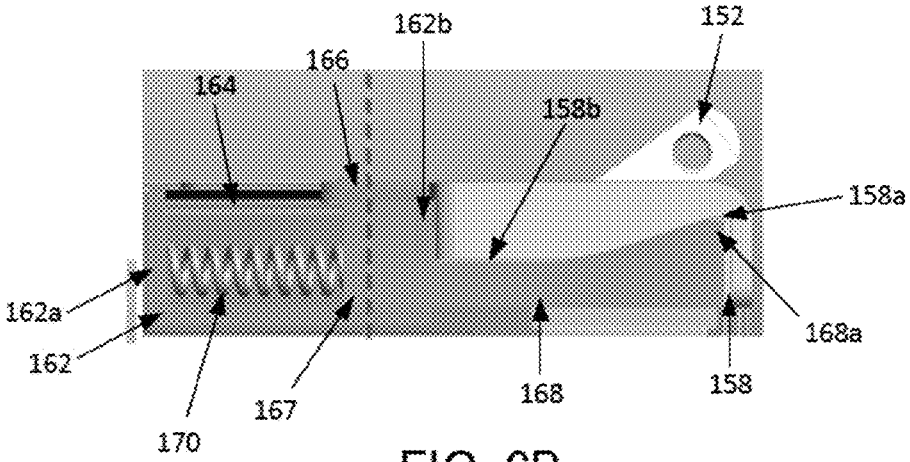
FIG. 6B is a side view of the actuator mechanism of FIG. 3 in a first state.

FIG. 6B is a side view of the actuator mechanism of FIG. 3 in a first state. In this example, the actuator mechanism is configured in a rest position. The slide 168 is disposed within the channel 158, with the raised portion 168*a* aligning with the raised end 158*a*.

Figure 6C:
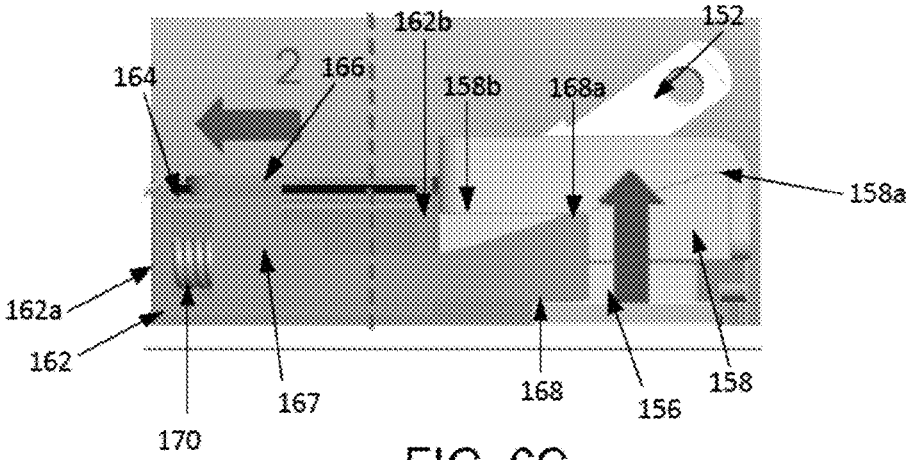
FIG. 6C is a side view of the actuator mechanism of FIG. 3 in a third state.

FIG. 6C is a side view of the actuator mechanism of FIG. 3 in a third state. In this example, the actuator mechanism is configured in the released position. As shown, the biasing member 170 is in a compressed state and the button is moved to the released position. Although not shown in FIG. 6C, the projection 172 is removed from within the recess 159, which allows the outlet attachment 150 to move without interference of the projection 172. The raised portion 168*a* of the slide 168 has moved within the channel to a position in the channel 158 with a height less than a height of the raised end 158*a*. As such, the raised portion 168*a* exerts a force on the channel 158, thereby causing a force on the outlet attachment in a direction perpendicular to the face on which the button is disposed. With the projection in the released position, the outlet attachment may then be detached from the brick 130.

FIG. 7 is a perspective view of a power adaptor according to another aspect of the disclosure. In this example, an outlet attachment 170 is attached to the brick 130. The outlet attachment 170 may attach and detach from the brick 130 using an actuator mechanism 160 as described above. In this example, the outlet attachment 170 includes an extension cable 172, a plug 174, and a plurality of prongs 176. As described above, the outlet attachment 170 may be configured to be used with a brick 130 that includes an actuator mechanism 160. In this regard, the outlet attachment 170 may include a recess, such as the recess 159 described above, as well as one or more channels, such as the channel 158 described above.

The actuator mechanism 160 described above may be incorporated into a power adaptor, such as the power adaptor 110 described above. In this regard, the actuator mechanism 160 may be at least partially embedded within a brick 130 of the power adaptor 110. In this configuration, one or more of the faces of the brick 130 may overlay portions of the actuator mechanism 160, such as the slide 168. In this regard, certain components of the actuator mechanism may be internal to the brick 130, and may not be visible to a user. For example, the actuator mechanism 160 may be configured such that only the button 166 and the guide 164 are visible to the user. In this way, the biasing member 170, the slide 168, as well as other components may not be visible to a user. This may provide aesthetic appeal to the power adaptor 110, and may also prevent a user from interfering with the components of the actuator mechanism 160.

As these and other variations and combinations of the features discussed above can be utilized without departing from the invention as defined by the claims, the foregoing description of the embodiments should be taken by way of illustration rather than by way of limitation of the invention as defined by the claims. It will also be understood that the provision of examples of the invention (as well as clauses phrased as "such as," "e.g.", "including" and the like) should not be interpreted as limiting the invention to the specific examples; rather, the examples are intended to illustrate only some of many possible aspects.

The invention claimed is:

1. A power adaptor, comprising:

a housing including a plurality of faces, an outlet attachment removably coupled to the housing, the outlet attachment comprising a recess formed in a surface of the housing and at least one channel; and an actuator mechanism, the actuator mechanism comprising:

a button, disposed on one of the plurality of faces of the housing, the button being configured to move between a plurality of positions, a projection configured to be disposed within the recess when the button is in a first position and to be removed from the recess when the button is in a second position, and a slide configured to exert a first force on a surface of the at least one channel when the button is moved from the first position to the second position.

2. The power adaptor of claim 1, further comprising a biasing member configured to bias the button toward the first position.

3. The power adaptor of claim 1, wherein the projection has an angled face.

4. The power adaptor of claim 1, further comprising a button support attached to the button, the projection, and the slide.

5. The power adaptor of claim 4, wherein the button, the button support, the projection, and the slide are integrally formed.

6. The power adaptor of claim 1, further comprising a cable attached to one of the plurality of faces, the cable being configured to supply power to a device.

7. The power adaptor of claim 1, wherein a given one of the plurality of faces of the housing includes a notch formed therein, the notch comprising an opening extending along a dimension of the given face.

8. The power adaptor of claim 1, wherein the housing has a substantially rectangular cuboid shape.

9. The power adaptor of claim 1, wherein the first force is exerted by the slide in a direction perpendicular to the face on which the button is disposed.

10. The power adaptor of claim 1, wherein the slide has a raised portion for exerting the first force on the surface of the at least one channel.

11. The power adaptor of claim 10, wherein the at least one channel has a raised end that correspondingly couples to the raised portion of the slide.

12. The power adaptor of claim 11, wherein the slide of the actuator mechanism includes a pair of slides and each of the pair of slides includes the raised portion, and wherein the at least one channel of the outlet attachment includes a pair of channels and each of the pair of channels includes a raised end that couples to the raised portion for a corresponding one of the pair of slides.

13. The power adaptor of claim 1, wherein the projection is configured to be removed from within the recess when the button is in an intermediate position between the first and second positions.

14. The power adaptor of claim 1, wherein the first force is exerted by the slide through movement between the first and intermediate positions and between the intermediate and second positions.

15. The power adaptor of claim 1, wherein the slide effects the first force to act through a distance sufficient to cause ejection of the outlet attachment from the housing.

16. The power adaptor of claim 1, wherein the outlet attachment further comprises an extension cable configured to provide power to the housing.

* * * * *